US009352359B2

(12) United States Patent
Lamjav

(10) Patent No.: US 9,352,359 B2
(45) Date of Patent: May 31, 2016

(54) DIRT SIFTING ATTACHMENT FOR WHEELBARROWS

(71) Applicant: Munich Lamjav, Eagle Mountain, UT (US)

(72) Inventor: Munich Lamjav, Eagle Mountain, UT (US)

( * ) Notice: Subject to any disclaimer, the term of this patent is extended or adjusted under 35 U.S.C. 154(b) by 3 days.

(21) Appl. No.: 14/202,058

(22) Filed: Mar. 10, 2014

(65) Prior Publication Data

US 2014/0367314 A1 Dec. 18, 2014

Related U.S. Application Data

(63) Continuation-in-part of application No. 14/164,348, filed on Jan. 27, 2014.

(60) Provisional application No. 61/956,560, filed on Jun. 12, 2013.

(51) Int. Cl.
*B07B 1/02* (2006.01)
*B07B 1/46* (2006.01)

(52) U.S. Cl.
CPC .... *B07B 1/46* (2013.01); *B07B 1/02* (2013.01)

(58) Field of Classification Search
CPC ..... B07B 1/00; B07B 1/02
USPC ..... 209/417, 420, 235
See application file for complete search history.

(56) References Cited

U.S. PATENT DOCUMENTS

| | | | | |
|---|---|---|---|---|
| 619,443 | A * | 2/1899 | Smith | 209/421 |
| 2,768,022 | A * | 10/1956 | Pope | 296/26.06 |
| 4,350,584 | A * | 9/1982 | Donington | 209/352 |
| 5,374,095 | A * | 12/1994 | Ramseth | 296/32 |
| 5,622,266 | A * | 4/1997 | Curtis | 209/235 |
| 5,839,772 | A * | 11/1998 | Toole | 296/32 |
| 8,317,031 | B2 * | 11/2012 | Zeller | 209/413 |
| 8,684,186 | B2 * | 4/2014 | Westgard | 209/370 |
| 2002/0144935 | A1 * | 10/2002 | Tims | 209/352 |
| 2011/0204169 | A1 * | 8/2011 | Pitchford | 241/68 |
| 2013/0056397 | A1 * | 3/2013 | Geller | 209/352 |

FOREIGN PATENT DOCUMENTS

DE 29619578 U1 * 1/1997

* cited by examiner

*Primary Examiner* — Ernesto Suarez
(74) *Attorney, Agent, or Firm* — Daniel Boudwin; Global Intellectual Property Agency LLC.

(57) ABSTRACT

Disclosed is a dirt sifting device for placement over a wheelbarrow, comprising a frame and a filter screen disposed over the frame. In an embodiment of the present invention, the dirt sifting device comprises a first frame connected by a hinge to a second frame. The hinge allows the first frame to rotate relative to the second frame and is adapted to maintain the frames at any of a variety of angles. A filter screen is disposed over each of the first and second frames. The frames define the perimeter of the filter screens. The frames may be rotated towards one another such that the frames overlap in a closed configuration convenient for storage. Alternatively, the frames may be rotated away from one another and the device can then be placed over a wheelbarrow for dirt sifting. Overall, the device serves as a means for separating dirt from unwanted materials.

10 Claims, 9 Drawing Sheets

DIRT SIFTING ATTACHMENT FOR WHEELBARROWS

CROSS REFERENCE TO RELATED APPLICATION

This application claims the benefit of U.S. Provisional Application No. 61/956,560 filed on Jun. 12, 2013, and is a Continuation in Part of U.S. Non-Provisional application Ser. No. 14/164,348, filed on Jan. 27, 2014 and entitled "Dirt Sifting Attachment for Wheelbarrows." The above identified patent application is herein incorporated by reference in its entirety to provide continuity of disclosure.

BACKGROUND OF THE INVENTION

1. Field of the Invention

The present invention relates to a device suited for sifting dirt. More specifically, the present invention pertains to a dirt sifting device having a frame, trusses, and a filter screen, wherein the device is suited for being placed over top of the open upper surface of a wheelbarrow and wherein the filter screen is capable of separating dirt from rocks and other debris.

Sifting dirt is a task that is commonly undertaken by gardeners to remove rocks, weeds, and debris from dirt or soil. Dirt is scooped into a wheelbarrow for the gardener to sort through by hand in order to identify and remove any unwanted substances. Sifting through dirt by hand is a laborious and time consuming process that requires the gardener to manually remove unwanted materials from the dirt. This process of manually removing unwanted materials also poses the problem that the gardener may not identify each weed or rock existing in the pile of dirt. Manually removing unwanted materials also requires the gardener to pay close attention to the dirt as it is being sifted.

Other devices for sifting through dirt are known but include a variety of drawbacks. Hand sifters may be available that allow the gardener to pour dirt that needs to be sifted into the hand sifter to remove unwanted materials. However, the small surface area of a hand sifter limits the amount of dirt that can be sifted at any given time. Thus, a user wanting to sift a greater quantity of dirt would need to continually sift small portions limited to the size of the hand sifter. Hand sifters and other small sifting devices still require the user to expend much energy and time sifting through a pile of dirt in order to properly remove unwanted materials.

The present invention relates to a dirt sifting attachment for a wheelbarrow that is capable of being placed over the upper surface of the wheelbarrow. The present invention comprises a continuous frame and trusses that bridge one side of the frame to the other. A filter screen is attached to the frame and is supported by the trusses so that the filter screen at least partially covers the open upper area of the wheelbarrow. The filter screen allows dirt to pass through and fall into the wheelbarrow, while preventing rocks and other debris from passing through. When the device is placed over the top of the wheelbarrow, a user could shovel dirt onto the filter screen and dirt would pass through into the wheelbarrow, while rocks would roll down the surface of the filter screen and onto the ground.

2. Description of the Prior Art

Devices have been disclosed in the prior art that relate to separating wanted and unwanted materials. These include devices that have been patented and published in patent application publications. The following is a list of devices deemed most relevant to the present disclosure, which are herein described for the purposes of highlighting and differentiating the unique aspects of the present invention, and further highlighting the drawbacks existing in the prior art.

One such device exemplifying the art is U.S. Patent Publication No. 2002/0144935 to Tims, which describes a sifter attachment for a wheelbarrow that can be used to sift wanted materials from unwanted materials. The device in Tims comprises a rectangular bin having an open upper end, walls, and a closed lower end, wherein the lower end has a number of drainage slots. The bin is attached by one or more hinges to the front outer edge of the wheelbarrow. The hinge allows the bin to pivot from a position outside the wheelbarrow to a position inside the wheelbarrow, so as to allow the user to dump the contents of the bin into the wheelbarrow by rotating the bin about the hinge. The device in Tims was principally designed for use in horse stalls so that a user could scoop manure into the bin and dry shavings would fall through the drainage slots and the manure would remain in the bin, which could then be emptied into the wheelbarrow for later disposal.

The device in Tims is suited to separating wanted and unwanted materials but suffers several drawbacks. The device in Tims is not easily removable from the wheelbarrow and must be attached to the wheelbarrow using a hinge. The separating device in Tims also serves to collect the debris and undesirable material while allowing the desired material to fall to the ground. Thus, if the user wants to collect the desired material, the device disclosed by Tims is of limited use. Additionally, the drainage slots may not be suited for applications other than sifting manure from dry shavings, in that the drainage slots may not be the appropriate size for filtering the desirable from the undesirable material.

Other devices known in the art suffer from a variety of drawbacks. Hand tools or sifters require the user to hold the sifter in one hand and scoop dirt with the other. This is an inconvenient arrangement, and the user is limited in the amount of dirt that can be sifted at a time. Hand sifters are not practical for sifting a large pile of soil, and are more suited to sifting smaller portions of soil. Filters or screens for use on the ground, or that are otherwise not for use with a wheelbarrow, are also problematic. Such filters allow a user to separate unwanted materials from the dirt, but the sifted dirt collects in a pile on the ground underneath the sifter. Sifting dirt onto the ground requires the user to shovel the sifted dirt into a container or into a wheelbarrow. This requires the user to expend more time and energy once the dirt is sifted.

In light of the devices in the prior art, it is submitted that the present invention is substantially divergent in design elements from the prior art, and consequently it is clear that there is a need in the art for an improvement to existing dirt sifting devices adapted for use with wheelbarrows. In this regard the instant invention substantially fulfills these needs.

SUMMARY OF THE INVENTION

In view of the foregoing disadvantages inherent in the known types of dirt sifting devices now present in the prior art, the present invention provides a new dirt sifting device adapted for use with a wheelbarrow wherein the same can be utilized for providing convenience for the user when sifting rocks, weeds, and other debris from dirt.

It is therefore an object of the present invention to provide a new and improved dirt sifting device capable of use with a wheelbarrow that has all of the advantages of the prior art and none of the disadvantages.

It is another object of the present invention to provide a dirt sifting attachment that can be placed on an upper surface of a wheelbarrow.

Another object of the present invention is to provide a dirt sifting attachment that allows dirt to pass through the filter screen and into a wheelbarrow, while preventing rocks and debris from passing through the filter screen.

Another object of the present invention is to provide a dirt sifting attachment in which the filter screen is not connected to the frame on the front portion of the wheelbarrow such that a user can dump the dirt collected in the wheelbarrow without having to remove the dirt sifting attachment.

Another object of the present invention is to provide a dirt sifting attachment that comprises a hinge which allows the attachment to be oriented in an open configuration for use, and a closed configuration for storage.

Yet another object of the present invention is to provide a dirt sifting device having a durable filter screen fabricated from materials that permit relative economy for sifting dirt from rocks, weeds, and other debris.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
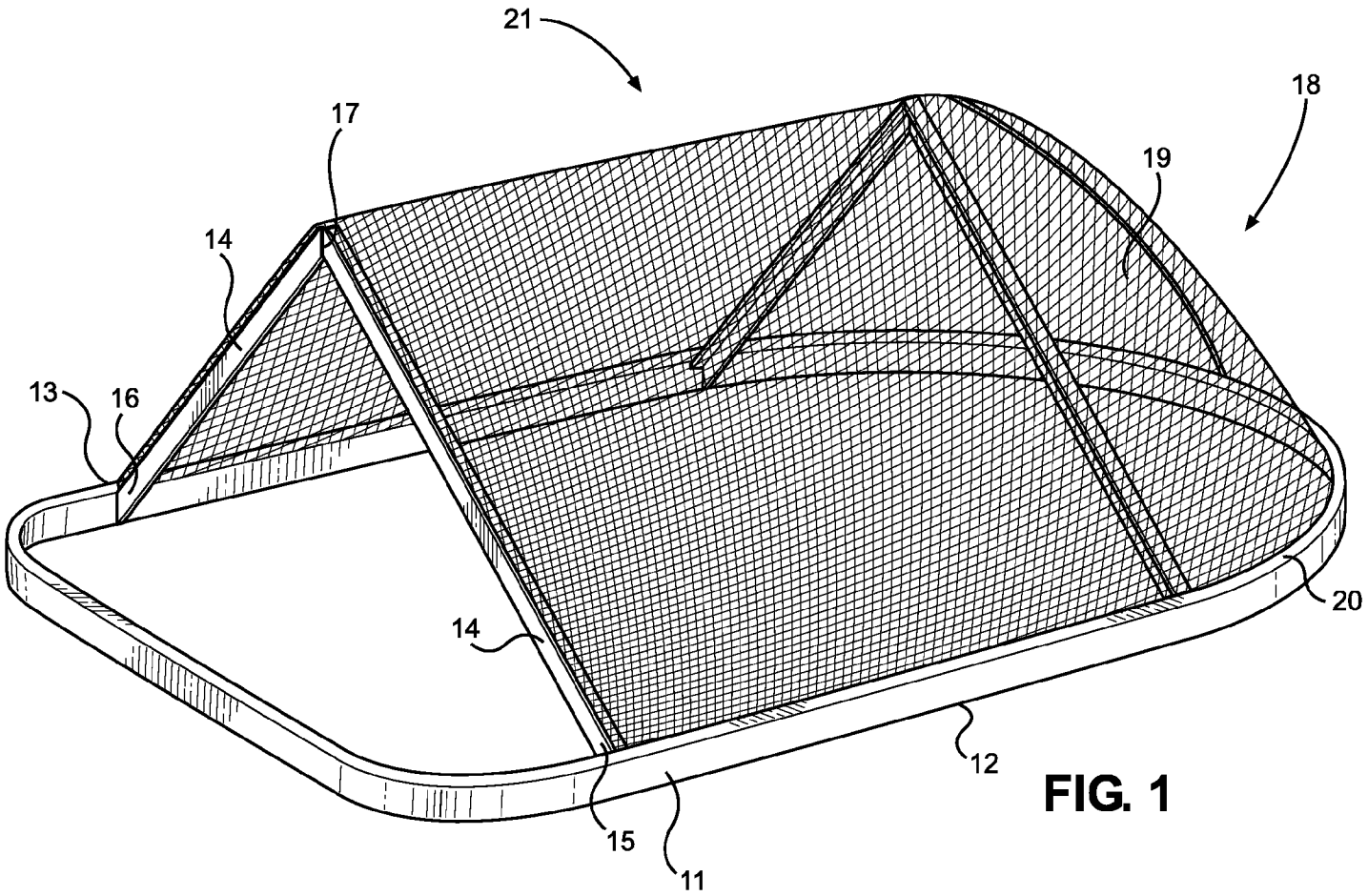
FIG. 1 shows a perspective view of the preferred embodiment of the dirt sifting attachment.

Reference is made herein to the attached drawings. Like reference numerals are used throughout the drawings to depict like or similar elements of the dirt sifting attachment. For the purposes of presenting a brief and clear description of the present invention, the preferred embodiment will be discussed as used for filtering rocks and other debris from dirt using a dirt sifting attachment for a wheelbarrow. The figures are intended for representative purposes only and should not be considered to be limiting in any respect.

Referring now to FIG. 1, there is shown a perspective view of an embodiment of the dirt sifting attachment for a wheelbarrow. The dirt sifting attachment 21 comprises a frame 11 that is continuous and is substantially planar. The frame 11 has a first side 12 that is substantially parallel to a second side 13. The frame further has a front end and a back end which connect the first side to the second side, so as to make the frame continuous. The frame 11 is shaped such that it is capable of being placed on the open upper surfaces of a wheelbarrow. Various shapes for the frame are contemplated. In some embodiments, the frame is substantially rectangular in shape. Alternatively, the front end of the frame may be curved so as to be shaped like the upper surfaces of a wheelbarrow.

Trusses 14 connect the first side 12 of the frame to the second side 13 of the frame. Each truss 14 has a first end 15, a second end 16, and a peak 17. The first end 15 of each truss attaches to the first side 12 of the frame, and the second end 16 of each truss attaches to the second side 13 of the frame. In the embodiment shown in FIG. 1, the trusses 14 are composed of multiple truss members. However, in some embodiments of the invention the trusses 14 are composed of a single truss member. The embodiment in FIG. 1 shows the trusses as having an L-shaped design. In another embodiment of the invention, the trusses are arched rather than L-shaped. In the preferred embodiment as depicted in FIG. 1, two trusses are used. In other embodiments of the invention one or more trusses may be attached to the frame.

A filter screen 18 having a surface area 19 and a perimeter edge 20 is attached to the frame 11 at the perimeter edge 20 of the filter screen 18. In the embodiment shown, the filter screen does not entirely enclose the frame of the dirt sifting attachment, and the filter screen does not connect to the back end of the frame. The surface area 19 of the filter screen 18 is disposed over the trusses 14 so that the trusses may support the filter screen 18 and hold it in place during operation. The trusses help to prevent the filter screen from deforming under the weight of the dirt and debris when the dirt and debris is shoveled or otherwise placed onto the filter screen.

Figure 2:
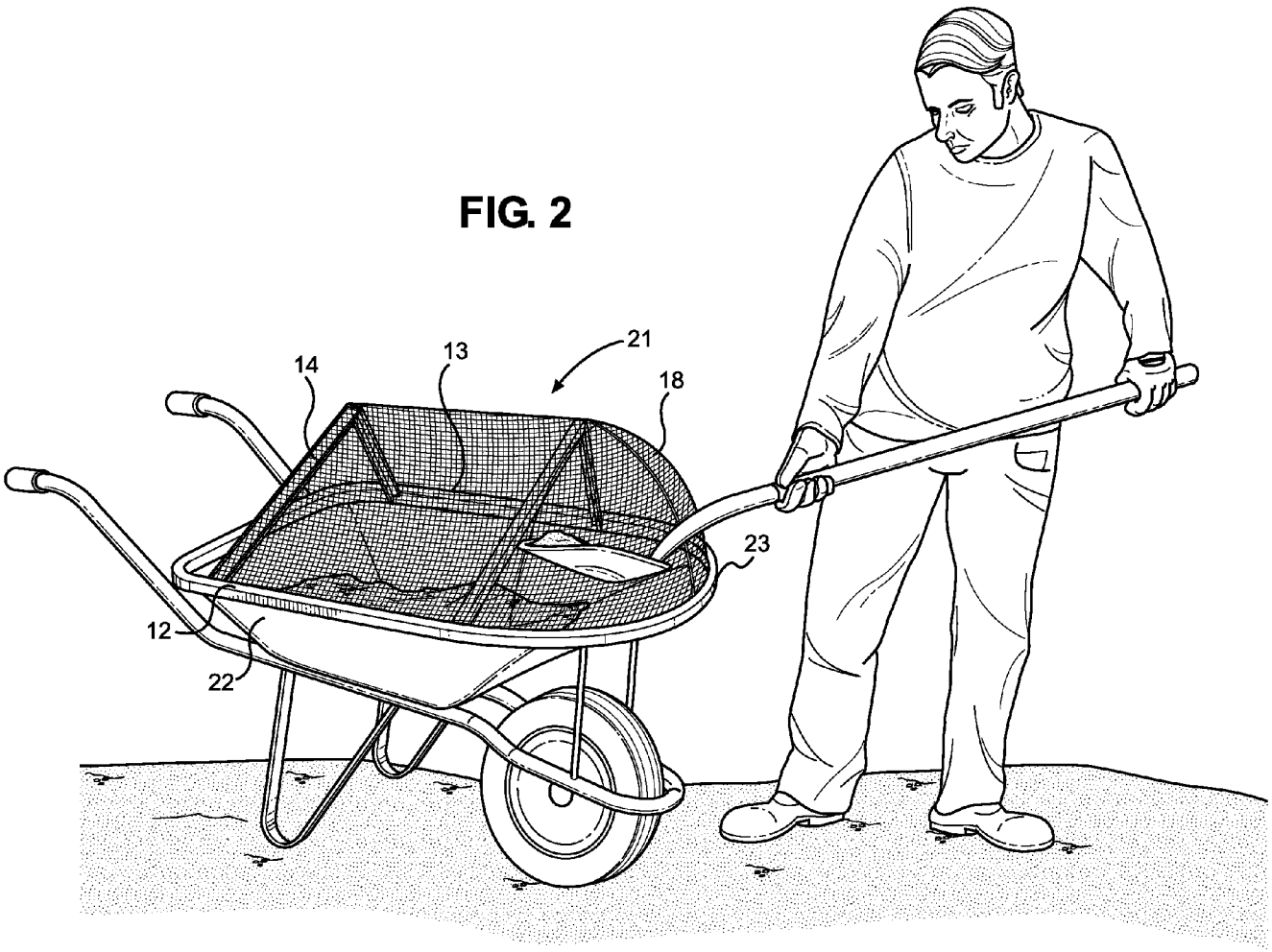
FIG. 2 shows a perspective view of the preferred embodiment of the dirt sifting attachment in a working position, disposed about the open upper surface of a wheelbarrow.

Referring now to FIG. 2, there is shown a perspective view of an embodiment of the dirt sifting attachment in a working position, disposed about the open upper surface of a wheelbarrow. The dirt sifting device 21 is placed over the upper surfaces of a wheelbarrow 22. The first side of the frame 12 and the second side of the frame 13 are placed along the upper surfaces of the wheelbarrow. In the embodiment shown in FIG. 2, the frame 11 has a rounded front end 23 so that the frame is shaped similar to the upper surfaces of the wheelbarrow 22.

The trusses 14 extend outward from the plane of the frame 11 and the trusses 14 are perpendicular to the first side 12 and second side 13 of the frame. The trusses 14 may extend outward from the plane of the frame 11 at a variety of angles, most preferably at forty-five degrees. The filter screen 18 is disposed over the trusses 14 such that the filter screen 18 is positioned coextensively with the trusses 14. The filter screen closely follows the shape of the trusses, and covers the open area of the wheelbarrow 22. In this way, the user may shovel or otherwise place a scoop of dirt onto the filter screen 18 at which point the dirt would fall through into the wheelbarrow 22 while the larger matter would remain on top of the filter screen 18 and roll down to the ground due to the angle of the filter screen 18.

Figure 3:
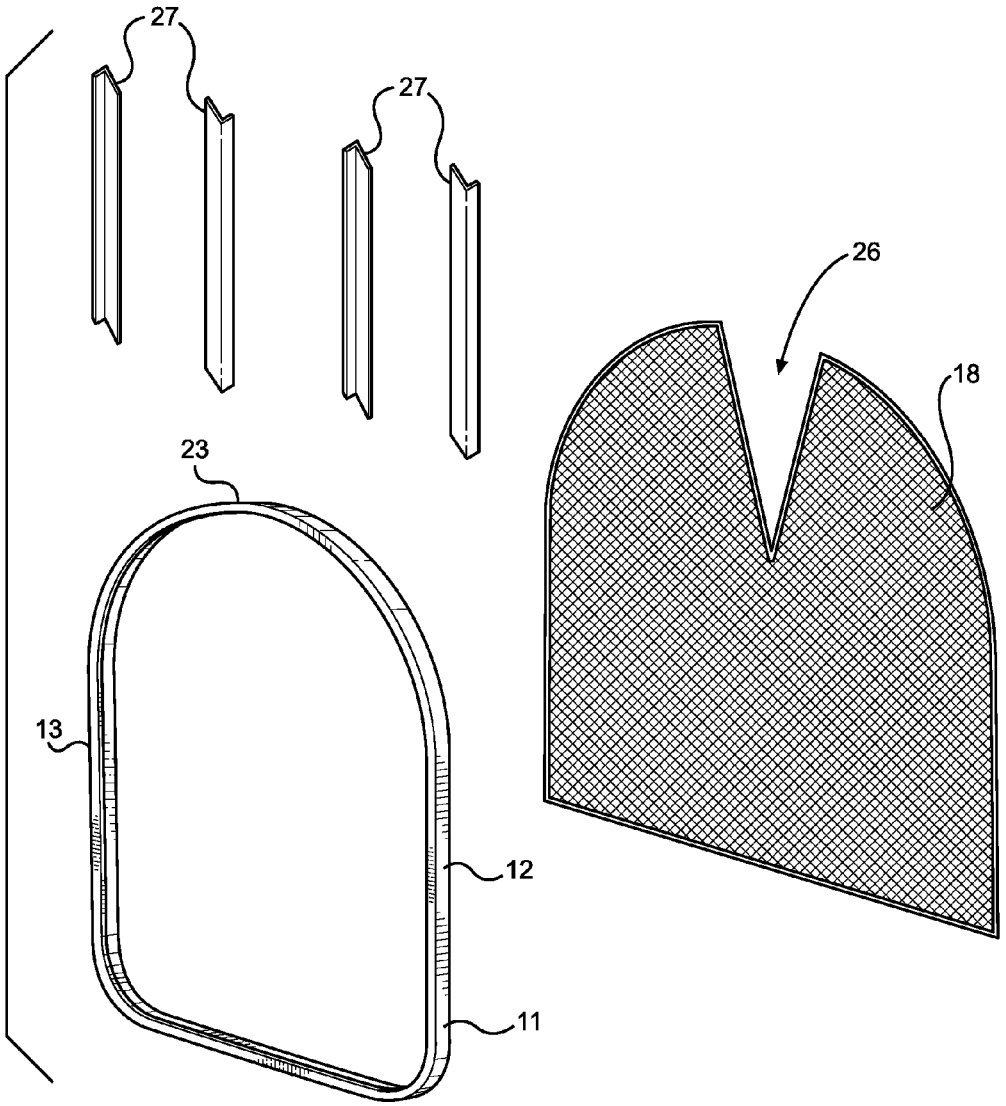
FIG. 3 shows a perspective view of the individual components of an embodiment of the dirt sifting attachment wherein the attachment is disassembled.

Referring now to FIG. 3, there is shown a perspective view of the components of an embodiment of the dirt sifting attachment, wherein the attachment is disassembled. In the embodiment of FIG. 3, the frame 11 is shown as having a first side 12 and a second side 13 being substantially parallel. The frame further comprises a front end and a back end which connect the first and second sides so as to make the frame continuous. In the embodiment shown in FIG. 3, the front end of the frame 23 is rounded such that the frame has a similar shape to that of a wheelbarrow. Truss members 24 are shown and are shaped such that a first truss member can be attached to a second truss member so as to form a truss 14 as shown in FIG. 1. The truss members have slanted ends so as facilitate connection of the truss members to one another and to the frame. A filter screen 18 is shown in the shape in which it would be manufactured. The filter screen has a cut out 26 that allows the filter screen to form a dome-like shape when disposed over the trusses and connected to the frame. The rounded front end of the frame necessitates a cut out in the filter screen in order for the filter screen to fit the shape of the frame. When the dirt sifting attachment is assembled, the filter screen fully encloses the front end of the dirt sifting attachment. The filter screen is flexible and can be attached to the frame and disposed over the trusses. In this way the filter screen can be placed so as to at least partially enclose the open upper area of a wheelbarrow.

In one embodiment of the invention, the different unassembled components of the dirt sifting attachment may be removably attached together to form the assembled dirt sifting device of FIG. 1. In this embodiment, the individual components of the dirt sifting device may be removably attached together using any of a variety of commonly known means of attachment including but not limited to screws, nuts and bolts, or joint connections. In this way, the user could easily assemble the device when it is desired to be used, and disassemble the device for more convenient storage or transportation. In embodiments of the invention wherein the components of the dirt sifting attachment are not removable, the trusses or truss members, the filter screen, and the frame are attached via a weld connection or alternatively, by means of an adhesive.

Figure 4:
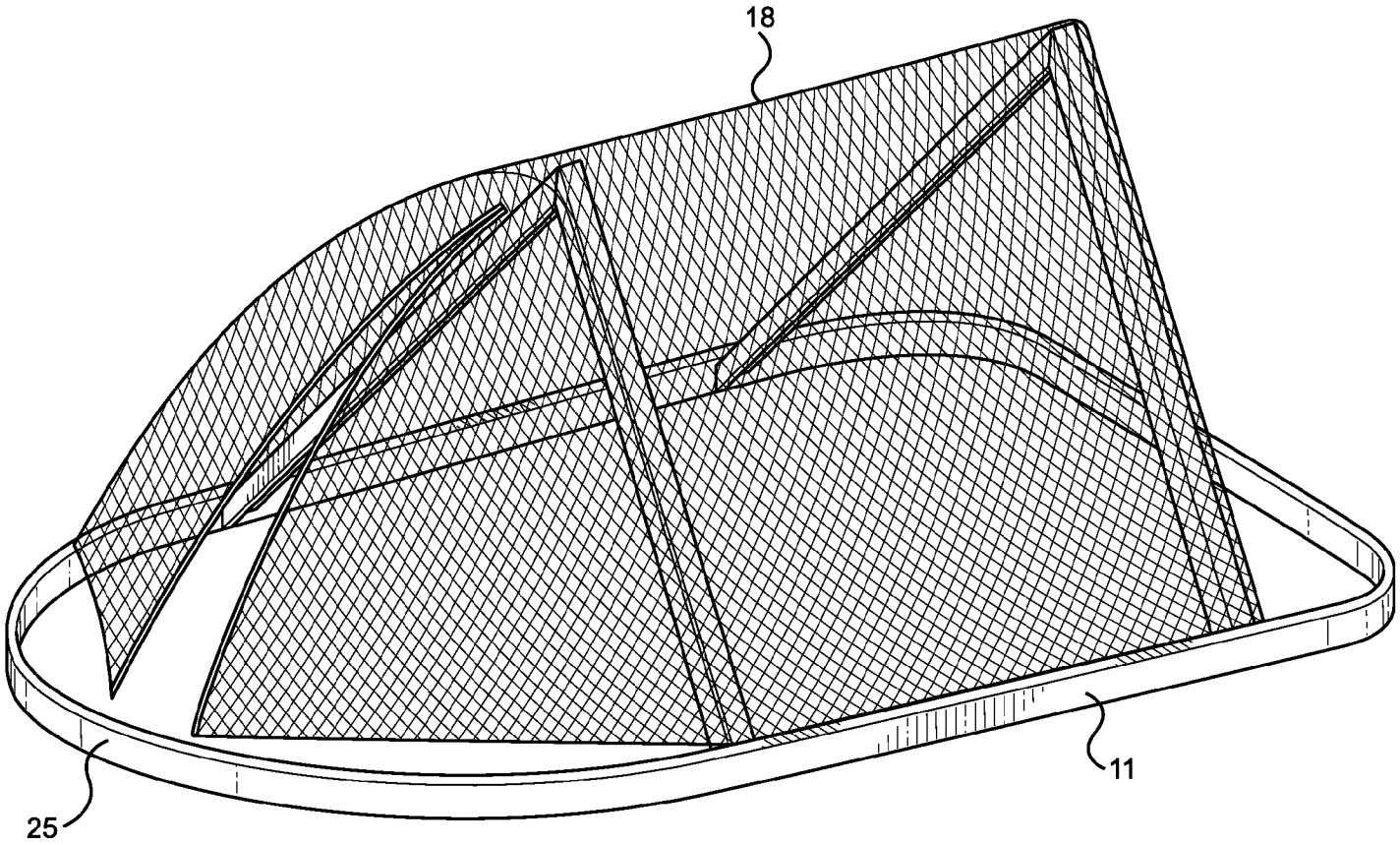
FIG. 4 shows a perspective view of an embodiment of the dirt sifting attachment, wherein the filter screen is not connected to the frame along the portion of the frame corresponding to the front of the wheelbarrow.

Referring now to FIG. 4, there is shown a perspective view of an embodiment of the dirt sifting attachment, wherein the filter screen is not connected to the frame along the portion of the frame corresponding to the front of the wheelbarrow. In the embodiment of FIG. 4, the filter screen 18 is not attached to the frame 11 along the portion of the frame that corresponds to the front of a wheelbarrow 25. This embodiment allows a user to dump the sifted dirt that has accumulated in the wheelbarrow onto the ground simply by tipping the wheelbarrow. When the wheelbarrow is tipped, the dirt could fall through the portion of the dirt sifting device where the filter screen is not connected to the frame. This allows a user to dump the wheelbarrow without having to first remove the dirt sifting device.

Figure 5:
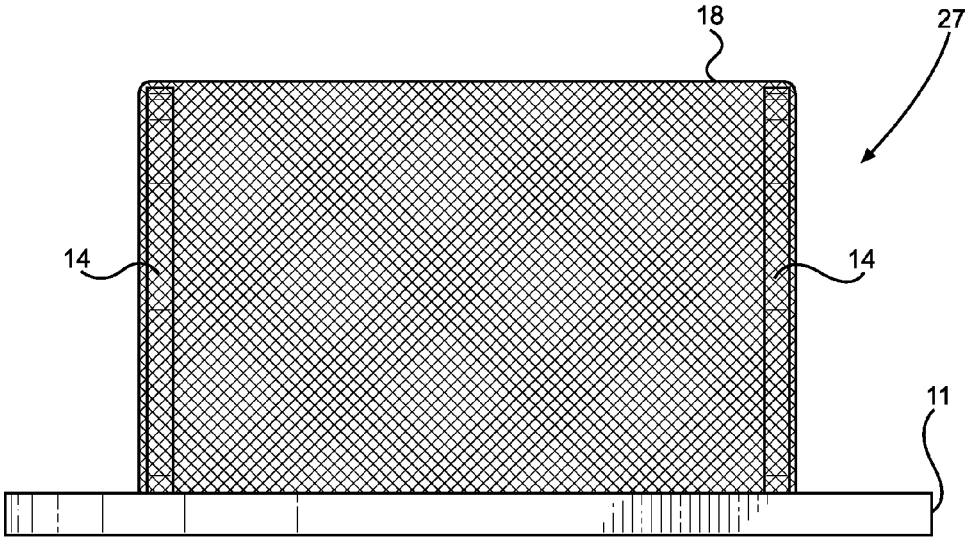
FIG. 5 shows a side view of an embodiment of the dirt sifting attachment, wherein the filter screen is rectangular.

Referring now to FIG. 5, there is shown a side view of an embodiment of the dirt sifting attachment, wherein the filter screen is rectangular. The dirt sifting attachment 27 has a filter screen 18 that does not enclose the entire frame 11. In this embodiment of the invention, the dirt sifting attachment is open at the front end and back end of the frame. The filter screen extends from the first side of the frame to the second side of the frame, and is disposed over the trusses 14. In this embodiment, the filter screen is substantially rectangular.

Figure 6:
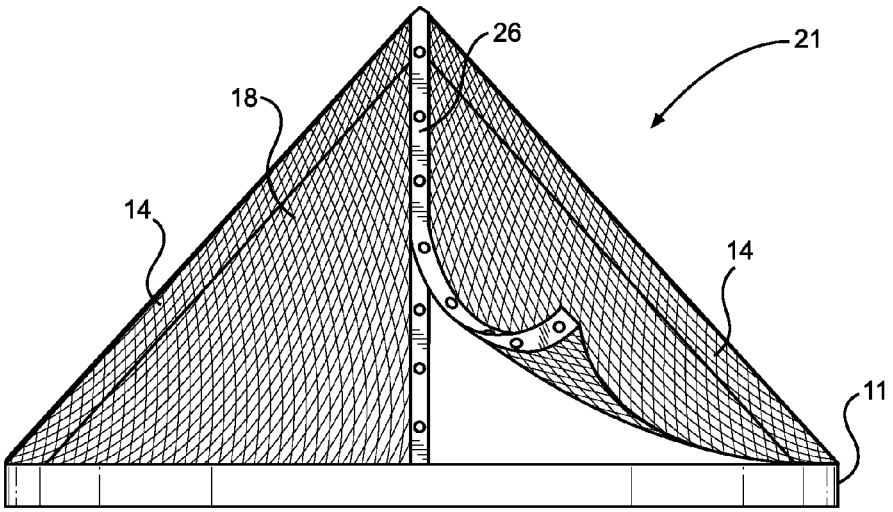
FIG. 6 shows a front view of an embodiment of the dirt sifting attachment, wherein the front of the filter screen closes by means of buttons.

Referring now to FIG. 6, there is shown a front view of an embodiment of the dirt sifting attachment, wherein the front of the filter screen closes by means of buttons. The dirt sifting attachment 21 has a filter screen 18 connected to the frame 11 and disposed over the trusses 14. In this embodiment, the front of the filter screen is closed and secured by means of buttons 26. In this way, the open upper area of the wheelbarrow is enclosed by the filter screen at the front end. The button closure secures together the portions of the filter screen that come into contact when the filter screen is disposed over the trusses and attached to the frame. Types of closures other than buttons are contemplated including a zipper type closure.

Figure 7:
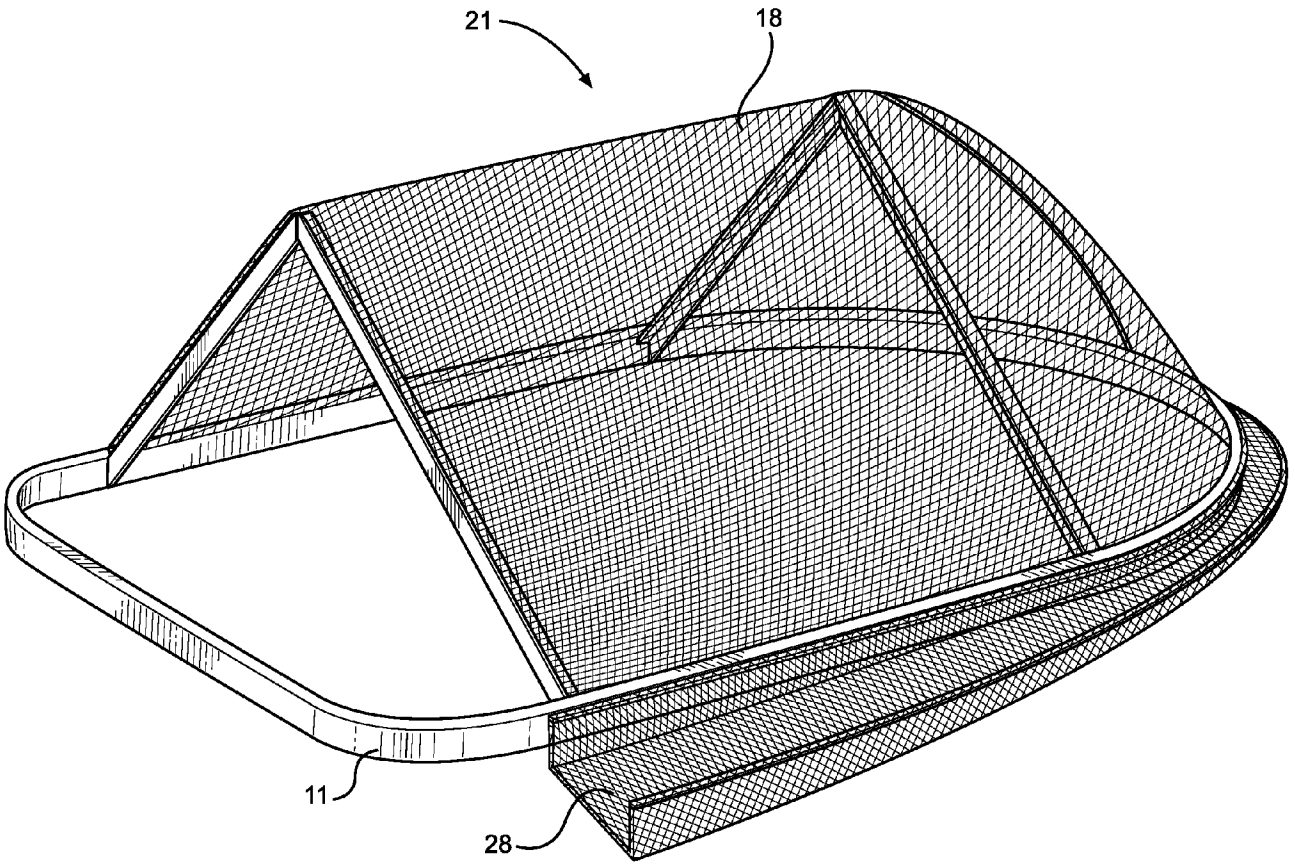
FIG. 7 shows a front view of an embodiment of the dirt sifting attachment, wherein the front of the filter screen closes by means of buttons.

Referring now to FIG. 7, there is shown an embodiment of the present invention having a gutter disposed along the side of the filter screen. The dirt sifting attachment 21 comprises a gutter 28 permanently attached to a side of the frame 12 and which extends from the back of the frame to the front of the frame. The gutter comprises sidewalls and a bottom so as to define a channel along the side of the frame. Rocks and other debris that cannot pass through the filter screen, roll down the filter screen 18 and are caught in the gutter. The gutter prevents rocks and debris from falling onto the ground where the user would have to separately collect them. Instead, the user can simply clean the rocks and debris caught in the gutter. The gutter in the embodiment shown is sloped from the front end of the wheelbarrow towards the back end of the wheelbarrow, and the gutter is open at the back end of the wheelbarrow. In this way, the gutter helps to funnel the rocks and debris towards the open end of the gutter, allowing the user to easily collect the rocks and debris. In other embodiments of the invention shown in FIG. 7, the gutter is removably attachable to the frame such that a user can choose whether or not to use the gutter. In additional embodiments of the invention, the gutter may be disposed around the first side, the front end, and the second side of the frame. In this way, the gutter would be capable of catching rocks and debris that roll down any portion of the filter screen.

Figure 8:
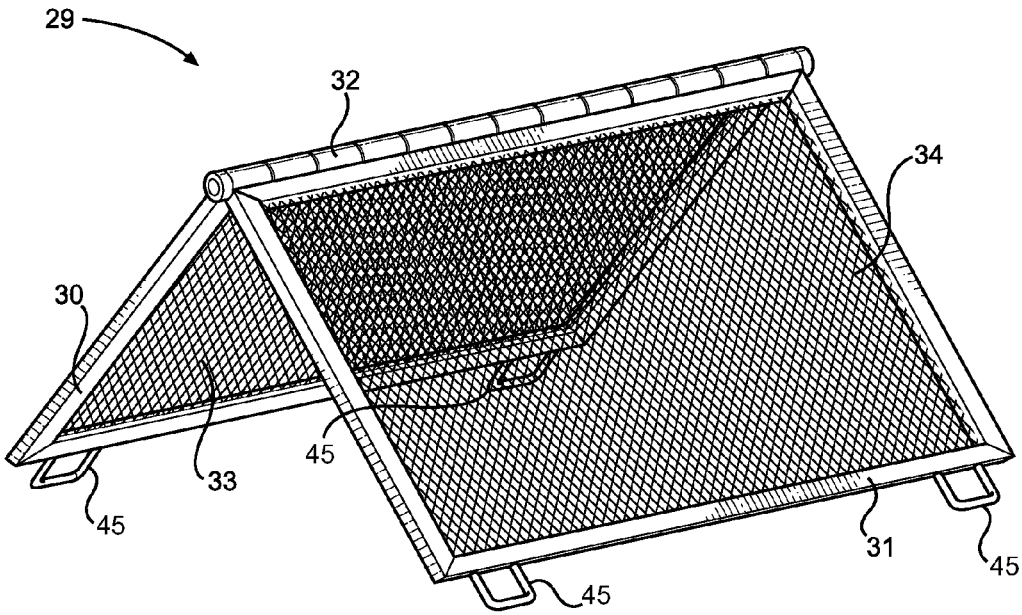
FIG. 8 shows a perspective view of a collapsible embodiment of the dirt sifting attachment of the present invention.

Referring now to FIG. 8, there is shown a perspective view of a collapsible embodiment of the dirt sifting attachment of the present invention. The dirt sifting attachment 29 comprises a first frame 30 connected by a hinge 32 to a second frame 31. The first frame 30 comprises a filter screen 33 disposed thereon, and the second frame 31 comprises a filter screen 34 disposed thereon. The filter screens 33,34 are secured about their perimeters to the frames 30,31, respectively. Each filter screen 33,34 is arranged such that it is substantially flat and planar. The first frame 30 and second frame 31 each comprise a substantially rectangular shape, however, in other embodiments of the present invention the frames comprise alternate shapes. The dirt sifting attachment 29 can be placed over the open upper area of a wheelbarrow and can be secured thereon. A user may then shovel dirt, rocks, and other debris onto the filter screens 33,34, and the dirt will pass therethrough, while rocks and large debris will roll down the sides of the dirt sifting attachment and onto the ground.

Optionally provided along the outer edge of each frame 30, 31 is one or more frame handles 45. The frame handles 45 are extensions that extend outward from the frames 30, 31 such that a user can utilize the same has hand holds when supporting the assembly 29 over a wheel barrow and between two users. The handles 45 are also useful for stabilizing the assembly 29 when positioned over a wheelbarrow and in an angled condition, as shown in FIG. 8. The frame handles 45 extend over the upper edge of the wheel barrow and stabilize the same during use. The handles 45 may be comprised of different geometry, falling within the scope of providing a location along the outer portion of each frame for a user to support the same or for securing the outer edge of each frame over the upper edge of a wheel barrow.

Figure 9:
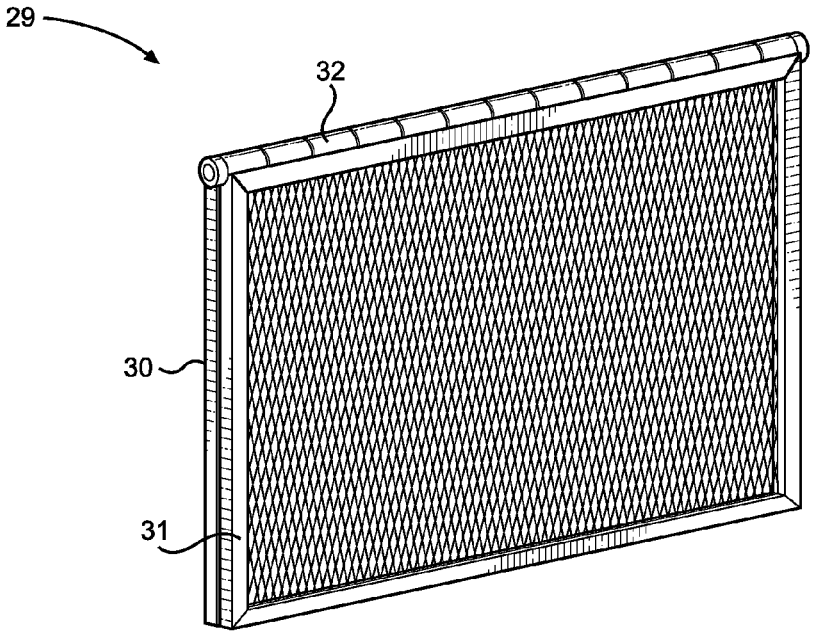
FIG. 9 shows a perspective view of a collapsible embodiment of the dirt sifting attachment in a collapsed configuration.

Referring now to FIG. 9, there is shown a perspective view of a collapsible embodiment of the dirt sifting attachment in a collapsed configuration. The dirt sifting attachment 29 can be rotated about the hinge 32 such that the first frame 30 overlaps the second frame 31. The first frame and the second frame comprise the same dimensions such that when the dirt sifting attachment is collapsed, the first and second frames are in contact. The dirt sifting attachment 29 can be quickly and easily collapsed when not in use, and the collapsed configuration allows for convenient storage and transportation of the dirt sifting attachment.

Figure 10:
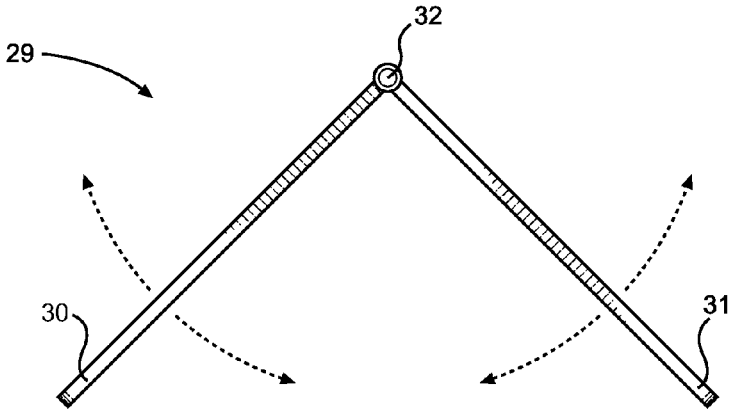
FIG. 10 shows a side view of a collapsible embodiment of the dirt sifting attachment in an open configuration.

Referring now to FIG. 10, there is shown a side view of a collapsible embodiment of the dirt sifting attachment in an open configuration. The hinge 32 of the dirt sifting attachment 29 allows the first frame 30 and second frame 31 to rotate towards or apart from one another. The hinge 32 is also adapted to allow the dirt sifting attachment 29 to be held and maintained open at any angle. In this way, the dirt sifting attachment 29 can be placed in an open configuration, and will not collapse under the weight of dirt or rocks placed onto the filter screen of the device. Thus, the hinge 32 is able to maintain the dirt sifting attachment open in a variety of angles.

Figure 11:
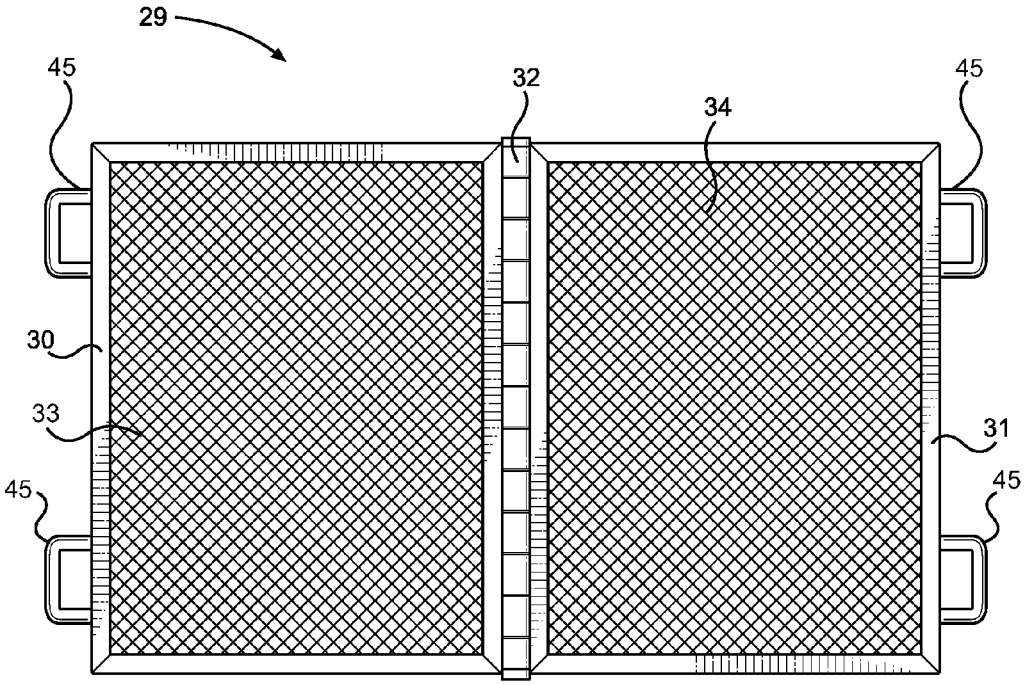
FIG. 11 shows a top view of a collapsible embodiment of the dirt sifting attachment in a flat orientation.

Referring now to FIG. 11, there is shown a top view of a collapsible embodiment of the dirt sifting attachment in a flat orientation. The hinge 32 is shown as extending along the entire length of the dirt sifting attachment, and the hinge 32 allows for a wide range of motion. The dirt sifting attachment 29 can be arranged in a flat orientation wherein the first frame 30 is arranged in the same plane as the second frame 31. Alternatively stated, the first frame and second frame can be positioned at a 180 degree angle. In this configuration, the user may place the dirt sifting attachment over a wheelbarrow, and can then shovel dirt and rocks onto the filter screens 33,34. The rocks and large debris will not pass through the filter screen, and will rest on top of the filter screen 33. The rocks and large debris can then be removed by the user as desired. The hinge 32 of this embodiment may restrict the angle between the frames to a given range, whereby the assembly is locked when positioned in a 180 degree (flat) position as shown in FIG. 11. Alternatively the hinge 32 may be provided without such limitation. Also shown in FIG. 11 is the positioning of the handles 45 along the frame outer edges. In this flat position, two users can support the opposite ends of the assembly while working.

Figure 12:
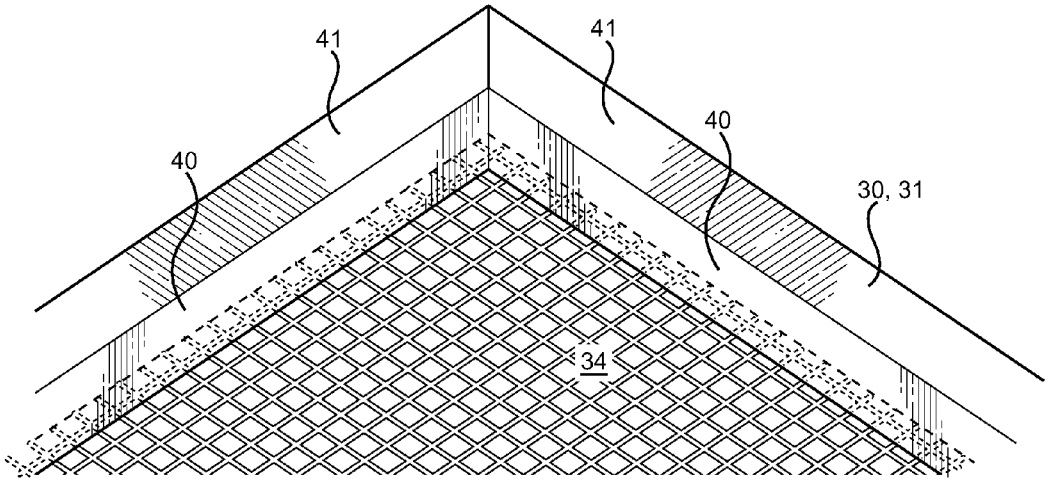
FIG. 12 shows a view of one frame corner of the collapsible embodiment of the dirt sifting attachment, wherein the filter screen is applied to one side of the frame such that the frame and filter screen form a partial interior volume to support dirt and rocks therein while sifting.

Referring now to FIG. 12, there is shown a close-up view of one corner of a frame 30, 31 of the collapsible embodiment of the dirt sifting attachment. This view illustrates how the filter screen 34 may be attached along one side of the frame such that the filter screen 34 and the interior walls 40 of the frame form a partially enclosed volume to support dirt, debris, and rocks when sifting the same. The assembly can be positioned such that the filter screen 34 is below each frame 30, 31, whereby the frame itself provides a perimeter wall and the filter screen 34 provides a lower sifting surface. This prevents larger debris and dirt from bypassing the screen 34 and falling from the side of the frame in use. The filter screen affixes to the frame along an upper surface thereof, whereby each frame forms a raised perimeter around the filter screen. This configuration as shown is but one configuration. The screen may also be attached in other configurations, as desired by the manufacturer.

Sifting unwanted materials out of dirt can be a laborious and time consuming process. Sifting by hand is particularly time consuming and does not ensure that all the unwanted materials will be removed from the soil. Hand sifters provide greater assurance that unwanted materials will be removed, but are limited by the size of the hand filter, and still require the user to hold the hand sifter in place during use. This arrangement is inconvenient to the user, and requires the user to sift the dirt in small portions suited to the size of the hand sifter. Further, other sifting devices for placement on the ground result in having the dirt sifted into a pile on the ground. If the user wishes to relocate the dirt, the user must shovel the dirt into a wheelbarrow or other container before moving the dirt to a desired location. This results in even more labor for the user in moving the sifted dirt into the storage container or wheelbarrow.

The present invention describes a dirt sifting attachment for a wheelbarrow that allows dirt to pass through the filter screen, but not larger matter. Further, the filter screen encloses the open upper area of the wheelbarrow, and the filter screen is oriented at an angle. In this way, a user can attach the dirt sifting device to a wheelbarrow, and simply shovel unsifted dirt onto the filter screen. Dirt would then fall through into the wheelbarrow, and larger matter would roll down the side of the filter screen and onto the ground. The filter screen ensures that only dirt will pass through and that unwanted material will not be collected. By shoveling dirt onto the filter screen, the user can quickly and efficiently sift the dirt pile by sifting larger portions of dirt than would be possible with a hand sifter or other similar device. Finally, the sifted dirt is neatly collected in the wheelbarrow for transportation to a desired location.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dirt sifting device adapted to be placed over a wheelbarrow, comprising:

a first frame connected by a hinge to a second frame;

wherein said first frame comprises a filter screen disposed thereon;

wherein said second frame comprises a filter screen disposed thereon;

wherein said first frame and said second frame pivot about a horizontal axis via said hinge to provide an open configuration and a closed configuration;

wherein said first frame and said second frame form a peak at said hinge above an upper rim of said wheelbarrow, defining an interior volume between said dirt sifting device and said wheelbarrow when in said open configuration;

the first frame having an outer edge, and the second frame having an outer edge;

the outer edge of the first frame further comprising one or more U-shaped handles extending therefrom;

the outer edge of the second frame further comprising one or more handles U-shaped extending therefrom;

the one or more U-shaped handles of the first frame being entirely coplanar with the first frame;

the one or more U-shaped handles of the second frame being entirely coplanar with the second frame;

each of the U-shaped handles adapted to receive the upper rim of the wheelbarrow between the handle and the respective outer edge of the first frame or the second frame;

each of the U-shaped handles further being adapted to form hand holds for a user;

an opening defined between each of the one or more U-shaped handles and the respective outer edge of the first frame or the second frame;

wherein the one or more U-shaped handles of the first frame and the second frame are uniform in construction.

2. The dirt sifting device of claim 1, wherein said filter screen on said first frame and said filter screen on said second frame are flat.

3. The dirt sifting device of claim 1, wherein said hinge allows for said first frame to be maintained at any of a variety of angles relative to said second frame.

4. The dirt sifting device of claim 1, wherein said first frame and said second frame are rectangular.

5. The dirt sifting device of claim 1, wherein said hinge allows said first frame to contact said second frame such that said first and second frame overlap.

6. The dirt sifting device of claim 1, wherein said first frame defines the perimeter of said first frame filter screen, and wherein said second frame defines the perimeter of said second frame filter screen.

7. The dirt sifting device of claim 1, wherein said hinge extends along an entire length of said first frame and said second frame.

8. The dirt sifting device of claim 1, wherein said filter screen affixes to said first frame and said second frame along an upper surface thereof, whereby said first frame and said second frame form a raised perimeter about said filter screen.

9. The dirt sifting device of claim 1, wherein said first frame overlaps said second frame in said closed configuration, whereby said first frame and said second frame provide a dual layered filter.

10. The dirt sifting device of claim 1, wherein said first frame rotates away from said second frame in said open configuration, whereby said first frame and said second are configured to partially enclose an area.

* * * * *